US005813787A

United States Patent [19]

Dowzall et al.

[11] Patent Number: 5,813,787

[45] Date of Patent: Sep. 29, 1998

[54] NIB UNITS FOR PENS

[75] Inventors: Martin Edward Dowzall, Franklin Lakes; Vazgen John Houssian, Union City, both of N.J.

[73] Assignee: Esselte UK Limited, Ashford, England

[21] Appl. No.: 295,829

[22] PCT Filed: Mar. 11, 1993

[86] PCT No.: PCT/GB93/00510

§ 371 Date: Oct. 12, 1994

§ 102(e) Date: Oct. 12, 1994

[87] PCT Pub. No.: WO93/17879

PCT Pub. Date: Sep. 16, 1993

[30] Foreign Application Priority Data

Mar. 11, 1992 [GB] United Kingdom ..... 9205398

[51] Int. Cl.[6] ..... B43K 8/02; B43K 8/12

[52] U.S. Cl. ..... 401/199; 401/18; 401/206

[58] Field of Search ..... 401/199, 206, 401/131, 18

[56] References Cited

U.S. PATENT DOCUMENTS 3,572,954 3/1971 Cheron ..... 401/18

4,913,175 4/1990 Yokosuka et al. ..... 401/206 X

FOREIGN PATENT DOCUMENTS 1418087 8/1964 France ..... 401/199

2489753 3/1982 France ..... 401/18

1068489 5/1967 United Kingdom ..... 401/199

2148200 5/1985 United Kingdom ..... 401/199

*Primary Examiner*—Steven A. Bratlie

*Attorney, Agent, or Firm*—Darby & Darby

[57] ABSTRACT

Fine lines, for example, 0.5 to 0.8 mm wide, can be produced by the use of an auxiliary nib unit which fits over a main nib on a felt or Fiber tip marker or on a technical pen. The auxiliary nib is a friction fit in its housing. The marker cap may contain a receptacle for storage of the auxiliary nib. The auxiliary nib is movable axially of its housing so as to come into ink-transfer contact with the main nib irrespective of wear or distortion of the latter. The main nib may be of fibrous material, and the auxiliary nib may be a hollow extrudate of plastics material.

12 Claims, 2 Drawing Sheets

NIB UNITS FOR PENS

This invention relates to nib units, especially for felt and fibre tip marker pens, though the invention is also of value in the field of technical pens.

Felt and fibre tip marker pens have found widespread acceptance in a variety of fields of use. They are available commercially in a substantial number of shapes and sizes depending upon the intended use. Common to all of them, however, is some form of ink reservoir adapted to enable ink to feed to a tip or nib formed of felted or laid fibrous material, the latter particularly in the case of smaller size nibs. The nib is protected against drying out, and inadvertent contact with other surfaces when the pen is not in use, by an end cap. The reservoir may be provided with a small passage to atmosphere, to keep the ink in the reservoir under atmospheric pressure irrespective of changes in its volume.

The size of the nib is an important consideration for felt and fibre tip pens. It determines the stroke width of a line drawn with the pen. The stroke width is usually chosen in line with the intended use of the pen, wide nibs being used for writing large inscriptions, e.g. on the outsides of parcels, or colouring in large areas when making artwork, and narrow nibs being used for fine artistic graphic work or for normal fine handwriting.

The particular selection of felt and fibre tip marking implement may depend on a variety of considerations. In the professional use of such markers for creating artwork, however, a major consideration is the availability of the marker in a given colour. There are several commercially manufactured ranges of coloured markers available in a wide variety of colours. Some of these are available as so-called "double-ended" markers, with a relatively-wide nib at one end and a relatively-narrow nib at the other, each with its respective end cap.

Ranges of such markers, commonly referred to as art markers, are purchased by graphic artists and commercial artists in particular, because of their availability in a wide range of colours.

Such artists sometimes find that in order to secure a specific effect, in particular to secure a desired very fine line, for use in detailed work, even the thinnest nib available is too wide for such use. The nibs of such markers are, however, often made of a parallel-oriented nylon, polyester or acrylic fibre compact, which has a relatively firm texture and which can be sharpened, as by using a craft knife, to give a considerably thinner nib.

The problem with such a thin nib is that while it may give entirely satisfactory results, the marker, once it has undergone surgery in this fashion, cannot be reinstated to its former condition and must often be discarded. This is clearly unsatisfactory.

GB-A-1 005 487 discloses a marking instrument having an ink container with a wick, and an interchangeable tip engageable on the container and including a marking element of which one end may be used for marking, and of which the other end contacts the wick so as to receive ink.

Pens offering a choice of nib sizes or point types, using capillary forces to transfer ink from one nib to another, are disclosed in various patent specifications.

U.S. Pat. No. 5,026,189 discloses a broad marker pen nib having a relatively-movable coaxial thin nib when can be caused to project through and beyond the tip of the broad nib.

U.S. Pat. No. 4,610,556 describes a multi-tip writing instrument. The nib units are interchangeable, and are all intended to be mounted in head-to-tail connection with a generally-axial ink flow. The nibs may be of the metal, ball or fibrous type, but there is no grading of nib sizes so that the ink flow is from broad to medium to fine.

U.S. Pat. No. 3,572,954 discloses a fibrous-tipped pen with a detachable head fitted with a metal nib or a ball. There is no disclosure of the extra nib being of the fibrous type, or of any provision for accommodating wear of the main nib.

Other specifications of different degrees of relevance include:

JP 54-12 533 discloses a cap carrying a fibrous auxiliary nib tapering to a point which can be jammed on to either end of a marker pen body having a fibrous main nib. When jammed onto the working end, the tapered nib has ink supplied to it by its contact with the broad nib. The tapered nib may in turn be capped by a second cap fitting on to the first cap.

JP 55-156 982 discloses a broad-based ink container supporting a very broad flat fibrous nib. Two fibrous nib units of successively-smaller size may be jammed in succession on the container body to give a choice of effective nib sizes fed from the same ink supply.

JP 59-146 183 is similar to JP 55-156 982, except that holders of smaller nibs are all of the same basic size, so that when in place, the two supplementary nibs and a cap have their holders in line with the cylindrical body of the basic broad fibrous marker pen.

JP 2-73 380 is another refinement of U.S. Pat. No. 4,610,556.

JP 53-109 929 discloses a fibrous rod providing a fine nib slidably mounted in a carrier mounted in the neck of an ink housing. Even when projecting from the carrier, the inner end of the rod has ink supplied to it by capillary forces.

JP 53-131 122, 54-118 236, 54-130 241, 54 145 239 and 54-160 242 relate to ball tip adaptors for fountain pen nibs.

JP 54-105 630 discloses a fibrous rod having one end supplied with ink and held in ways permitting it to be fed longitudinally as the outer end wears.

JP 56-123 286 discloses a double-ended fibrous nib device. When wedged into a holder, one end of a fibrous rod is in contact with an ink-impregnated body, while the exposed other end acts as a nib. The holder is reversible to give a choice of nib ends.

JP 57-19 074 discloses the fine fibrous nib of a pen having its inner end in contact with a fibrous rod having its other end abutting a permeable block dipping into an ink reservoir.

JP 57-169 477 and 3-6 988 discloses a set of fibrous nib units of successively-finer size pushed together end-to-end so that the nib of one unit supplies ink to a permeable mass of the next unit which supplies ink in turn to its (finer) nib.

JP 58-115 379 and 62-180 580 disclose an inner thin fibrous rod movable along the axis of a broad fibrous nib.

JP 61-111 784 discloses a slidable cap limiting the extent to which a fibrous brush splays out from the narrow neck of a marker pen.

The present invention aims at giving users of marker pens able to draw lines of one width the ability to fit such pens with very fine line auxiliary nibs which have ink supplied to them from the main nib, and which come automatically into ink-transfer contact with the main nib as soon as the user presses the auxiliary nib against a record medium.

None of the known markers satisfactorily provides a reversible or optional fine line nib which can be fitted with ease and reliability of operation irrespective of wear or deformation of the main nib. The present invention provides, in an auxiliary nib unit for use in conjunction with a felt or fibre tip marker or other writing implement having a capillary-fed main nib, a housing adapted to engage on the main nib of a marking implement, or on the end of the implement adjacent its main nib, the improvement comprising a fine auxiliary nib slidable axially in its housing and adapted, when the housing is so engaged, for one of its ends to enter into ink-transfer relationship with the main nib, and having its other end projecting from the housing and adapted to operate as a capillary-fed auxiliary-nib.

The housing may engage over the main nib of the existing marker implement and, indeed, engage solely on that nib. Alternatively, the housing may engage on, for example, a collar forming part of a marker and immediately adjacent a projecting felt or fibre tip nib portion.

Preferably the housing is a press or friction fit on the marker or its nib, and can be removed by simply pulling it off after use, without damage to the main nib.

The auxiliary fine nib may consist of a sheathed or bare compact bundle of axially-oriented fibres of nylon, polyester or acrylic, or of a like hollow extrudate of a plastics material. This is set into the housing sufficiently loosely to enable the axial movement noted above, though not to loosely as to be displaceable by gravity.

The axial displaceability ensures that the auxiliary fine nib is in appropriate pressure contact with the main nib at all relevant times. If on engagement of the housing over the main nib, such contact is not immediately established, it occurs as soon as writing pressure is applied, whereupon the auxiliary fine nib moves and contacts the main nib to establish capillary flow of the ink medium, and absorbs the writing pressure.

In one form of the invention, a receptacle is provided for storage of the auxiliary nib, conveniently as part of the marker cap moulding. By appropriately dimensioning the receptacle, the auxiliary nib may be a press fit in the receptacle but not fit so tightly that it cannot be withdrawn by engagement with the main nib or casing of the marker itself and subsequent pulling. After use, the auxiliary nib may be removed by being pulled off the main nib or casing and re-inserted in the cap. If the cap has means to hold the auxiliary nib temporarily firmly to enable it to be pulled from the marker, it may be re-inserted into the receptacle and temporarily held there while the marker is withdrawn. Such means may be a clip or catch, or be provided by making the receptacle wall so thin that, simply by transverse pressure on the outside of the wall of the receptacle, sufficient deformation of the internal shape of the receptacle occurs to hold the auxiliary nib in it and prevent it from being withdrawn as the marker is pulled away.

The provision of a receptacle for the auxiliary nib maintains the auxiliary nib secure and available for re-use. It is found that, with most marker ink formulations, no special precautions need to be taken if the auxiliary nib is sufficiently narrow and formed of appropriate material. It does not clog on drying out. Any drying tends to be confined to the ends of the nib proper and the resultant crust re-dissolves very rapidly when the auxiliary nib is next used. The wider the auxiliary nib, the greater is the tendency to dry out, though, given time, re-dissolution of the dried ink will occur when the auxiliary nib is re-used. Accordingly, if it is desired to have such wider auxiliary nibs rapidly re-usable, it is preferable to reduce drying out, as by providing the auxiliary nib with a hermetic cover or seal.

Preferably the cap of such a marker, in addition to including at least one receptacle for storing an auxiliary nib, has an external markable section, such as an area of matt white coating, on which the colour of the marker ink (and therefore the colour of the ink traces produced by the main and auxiliary nibs) can be recorded simply by using the marker on the matt white section. This enables the cover to be associated with the right marker from the selection usually present on a graphic artist's bench, and prevents possible loss of colour fidelity should an auxiliary nib which has been used on the marker of one colour subsequently be placed on the main nib of a marker of a different colour. While any modification to the colour applied by the second marker via the auxiliary nib may be transient, it would, of course, be annoying and possibly lead to spoilage. Instead of an area integral with the cap, an end cap or insert may be provided for the same purpose of colouring and subsequent identification.

Preferably the housing of the auxiliary nib consists of a resilient plastics or rubber material, though it may be of metal or other relatively rigid material if appropriate. The main nib is preferably of nylon, polyester or acrylic fibre compacted into a capillary-fed cylinder or fascicle, of appropriate diameter, moulded in or inserted into the housing.

The present invention may be applied to reducing the effective nib size of wide markers to convert them into narrow markers, or for converting markers with narrow or fine nibs into markers with ultra-fine nibs. For example, normal fine nib art markers have a nib diameter of about 1.5 mm. Using the present invention, auxiliary nibs may be produced of only 0.5 mm diameter. Auxiliary nibs may also be produced to fit on to technical pens. For example, a range of auxiliary nibs of widths 0.5 to 0.8 mm may fit on to a technical pen main nib of size 1.0 mm.

It has to be appreciated that the width of a line drawn by a fibrous or plastics nib is dependent on more than just its outside diameter. In addition to external factors such as the nature of the paper being marked and the ink being used, there are internal factors relating to the nib construction. In the case of resin-bonded fibrous nibs, the nature and proportions of the resin affect the 'softness' of the nib. In the case of extruded nibs, the cross-sectional shape of the extrusion, as well as the properties of the plastics material, determine the width of the lines able to be drawn by them.

Thus a manufacturer has various parameters available to enable him to produce main and auxiliary nibs able to draw lines of a desired width on a known paper using a known ink.

The present invention thus enables very fine lines to be drawn with felt or fibre tip pens, particularly coloured felt or fibre tip art markers.

The present invention is of particular value in that it enables very fine line markers to be produced without the problems of damage which militate against making normal felt or fibre tip writing implements with nibs too thin. The thinner the nib, the more likely it is to be damaged and the shorter its service life. In accordance with another aspect of the present invention, a plurality of auxiliary nibs, each comprising a fine nib in a housing, is may be provided for use with a single felt or fibre tip marking implement having a relatively greater diameter nib. Each time the very thin auxiliary nib becomes damaged, as by bending or wear, the entire auxiliary nib unit, consisting of housing and fine nib, may be discarded and replaced by a fresh one.

The invention is illustrated by way of example with reference to the accompanying drawings, in which.

Figure 1:
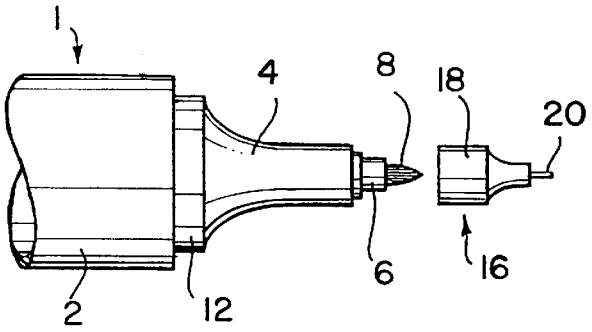
FIG. 1 is a schematic exploded side view of a fibre tip marker with an auxiliary nib unit according to the present invention.

Referring to the drawings, a fibre tip marker 1 of known type consists of a barrel 2 having a narrowing neck portion 4 terminating in a collar 6 which embraces a capillary-fed fibre tip main nib 8 2.0 mm in diameter.

Figure 4:
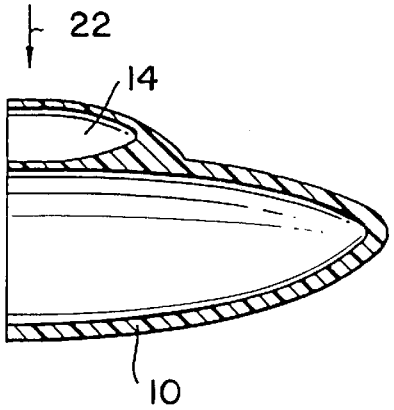
FIG. 4 is a longitudinal section through a cap and receptacle for the marker and auxiliary nib of FIG. 1.

In order to prevent such a marker from drying out, it has a resilient plastics cap 10 (FIG. 4) which fits over shoulder 12 of the barrel, being a friction fit on it.

The cap 10 has moulded on to it a lateral receptacle 14 for housing an ultra-fine auxiliary nib unit 16 of the present invention.

Figure 3:
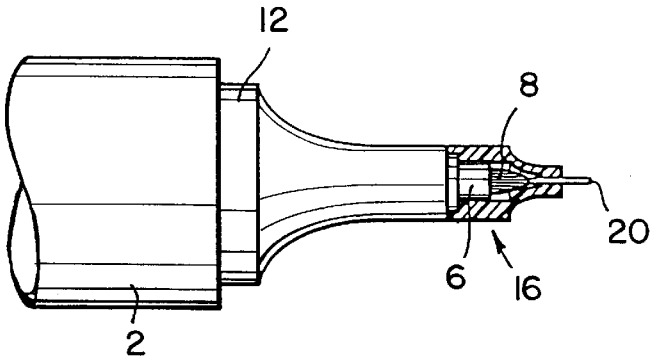
FIG. 3 is a side view, partly in section, showing the unit of FIG. 2 fitted on the marker of FIG. 1.

This unit 16 consists of a resilient plastics housing 18 carrying a thin auxiliary nib 20. Nib 20 projects outwardly of housing 18 to form a writing point, and is long enough to project into the hollow space in the interior of housing 18 by an amount sufficient that, when the housing 18 is press fitted over collar 6, as shown in FIG. 3, its inner end is able to be pressed against the end of the main nib 8. In accordance with the present invention, the auxiliary nib 20 is movable axially of housing 18. The contact between the auxiliary nib and its housing is a friction fit, so that the nib 20 cannot drop out of housing 18 when normal gravitational and like forces are applied to it, but the friction can be overcome by the axial forces applied to the nib tip when the user prepares to draw very fine lines on a record medium. The resultant axial movement brings the inner end of the auxiliary nib into ink-transfer and load-bearing contact with the main nib.

The auxiliary nib 20 is 0.8 mm in diameter, which is much finer than the main nib 8.

When no longer required for use, the unit 16 on the end of the marker is inserted into receptacle 14 in cap 10. Force exerted on the receptacle 14 in the direction of arrow 22, as by using a thumbnail, or by moving the body 2 of the marker so that its axis no longer coincides with the axis of receptacle 14, in either case holds unit 16 in receptacle 14 more firmly than it is attached to collar 6. The marker 1 is then pulled away and the resilient skirt of cap 10 pulls off from collar 6, leaving the unit 16 securely located in the receptacle 14 in the cap. The cap 10 can then be used to cover the main nib 8 of the marker in the usual way.

Figure 5:
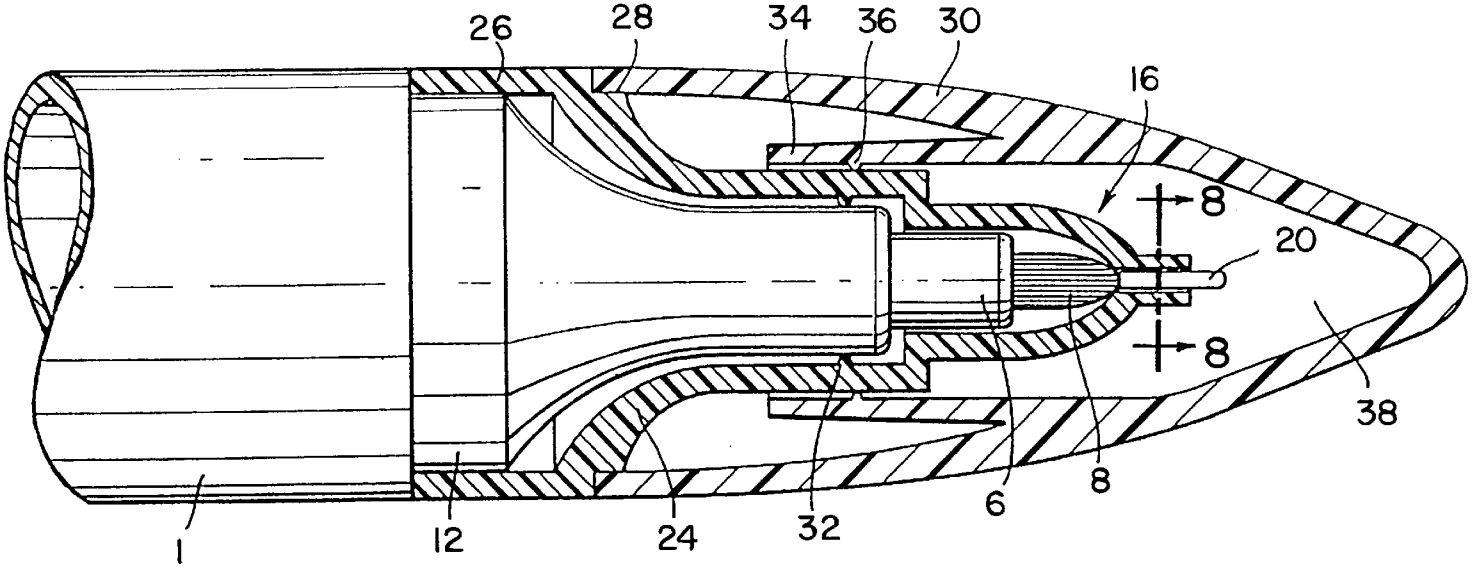
FIG. 5 is a view, part in section and part in elevation, of an alternative embodiment of the present invention.

In that alternative form of the invention shown in FIG. 5, components already described will retain the same references. In this embodiment, the auxiliary nib unit 16 takes the form of a housing 24 of plastics material fitting on to shoulder 12 on the marker pen 1 by virtue of the resiliency of a skirt 26 forming part of the housing. The housing 24 is formed with a shoulder 28 of the same diameter as shoulder 12 of the marker, so that a common cap 30 can fit equally well on the auxiliary nib unit if in place, or directly on shoulder 12 of the marker body 1 if the unit has been removed.

Figure 7:
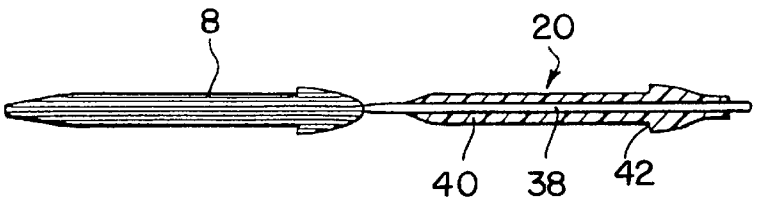
FIG. 7 is a view, part in section and part in elevation, of a fibrous main nib and an extruded auxiliary nib, in their working positions, with every other component omitted.

In an inner surface of housing 24 is an annular rib 32 intended to locate on the outer surface of the narrow end of neck portion 4 of the marker, adjacent to its main nib. At its narrowest end, the housing 24 is formed with a cylindrical opening in which the ultra-fine auxiliary nib 20 is fitted. As already mentioned, the nib 20 is a sliding fit in housing 24, so that when writing force is applied to its tip, the nib 20 may move as a whole until it abuts the main nib 8. In this way, even though a long period may elapse between successive uses of the auxiliary nib unit, during which period the main nib 8 may have become worn down or distorted, on the first use of the auxiliary nib unit after it has been reattached to the marker 1, the nib 20 is able to take up the wear on nib 8 by moving under the writing force rearwardly into ink-transfer and load-bearing relationship with the main nib. Such a relationship normally involves end-to-end contact between the two nibs (as shown in FIG. 7), but it is within the purview of the present invention to allow for misalignment of the two nibs. Should such misalignment take place, or should the main-nib become worn unevenly, the auxiliary nib is of such a material that it is able to come into ink-transfer and load-bearing contact with main nib 4 even on its side surfaces, as opposed to directly with its tip.

It has been found that there is no need to enlarge the area of contact between the two nibs to get efficient ink transfer. As long as most of the cross-sectional area of the fine nib is in contact with the main nib, then that is sufficient to get the full flow of ink from the auxiliary nib, and to bear transmitted normal writing forces without excessive deformation of either nib or movement of the fine nib.

Similarly to rib 32 on housing 24, the cap 30 has an internal skirt 34 having its own inner rib 36. This both assists in locating the cap 30 on the auxiliary nib unit when in place, but also seals the relatively-small internal volume 38 of the cap to reduce any tendency for the ink in nib 20 to dry out.

Preferably the grip of rib 36 on housing 24 is greater than the combined grips of rib 32 and skirt 26 on the marker body 1. This ensures that when only cap 30 is gripped and pulled away from the marker, the housing is removed with the cap to expose the main nib 8. When the auxiliary nib 20 is to be used, the user grips the skirt 26 when pulling the cap 30, so that only the cap is removed.

Although not shown in the drawings, those parts of the cap 30 which do not provide a hermetic seal to reduce any drying-out of the auxiliary nib may be perforated to provide air-flow passages preventing asphyxiation should the cap become lodged in a child's throat.

Figure 6:
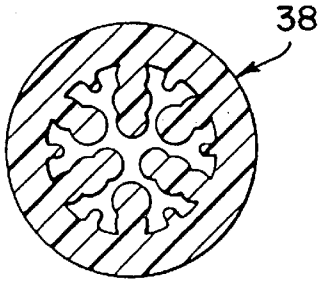
FIG. 6 is a cross-section of a typical extruded plastics nib, on a greatly-enlarged scale.

As already mentioned, the main nib 8 may be of felted or laid fibrous material, whereas the ultra-fine auxiliary nib 20 is preferably made of extruded polyacetal (homopolymer and/or copolymer), or polyester. A typical cross-section of a plastics nib made by an extrusion process is shown in FIG. 6. Ink in the interior spaces of the extrudate 38 is made available to flow to the exterior thereof when the marking end of the auxiliary nib is cut to form the desired rounded end or 'point'. Apart from the manner of mounting the auxiliary nib, its diameter relative to main nib 8 is the same as in the embodiments already described. That is to say that the diameter of the main nib 8 is about 2.0 mm, whereas that of auxiliary nib 20 is 0.8 mm.

Although the auxiliary nib 20 (FIG. 7) may take the form of a bare extrusion, it is preferred to provide it with a sheath 40. The sheath may be of metal or, as shown in FIG. 7, of a coloured plastics material. This sheath is intimately bonded to the extrudate 38, to give it mechanical strength, and has a smooth cylindrical outer surface of known diameter to give the desired friction fit in the cylindrical passage 44 (see FIG. 8) at the narrow end of housing 24. The sheath 40 may have, as shown in FIG. 7, a shoulder 42 on it to assist mechanical handling of the unit during manufacture when it is being assembled into this housing; it also enables a user to grasp and remove unit 20 and replace it with a new one.

When the main and/or auxiliary nibs have become so worn down as to need replacement, the shoulder 42 comes into contact with the end face of the housing, to limit the inward movement of the auxiliary nib 20.

Figure 8:
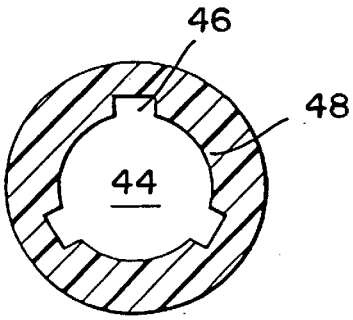
FIG. 8 is a section on the line VIII—VIII of FIG. 5, showing the cross-sectional shape of the end of the auxiliary nib holder.

Although, as already mentioned, the friction fit of the auxiliary nib 20 in its housing may be achieved by making the nib 20 or sheath 40 with a cylindrical outer surface which is just greater than the inside diameter of the passage 44 in the housing, to produce the necessary friction by slight deformation of the nib or its sheath, additional manufacturing tolerance may be provided by the shape of the housing. As shown in FIG. 8, the passage 44 may be contiguous with three axial or helical channels 46, so as to divide the inner surface of passage 44 into three angularly-spaced lands or ribs 48. The angular extend of each rib 48, and/or its radius, are chosen to give it the desired grip on extrudate 38 or sheath 40, to hold it reliably in place but able to slide axially when sufficient force is applied to the writing end of nib 20. The channels 46 may function additionally to allow air to flow between the auxiliary nib and its housing, to replace the volume of ink withdrawn from the marker by use.

Figure 2:
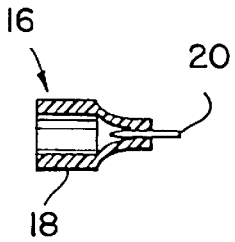
FIG. 2 is a longitudinal section through the auxiliary nib unit shown in FIG. 1.

It will be appreciated that, because of its significantly-greater size than the auxiliary nib units shown in FIGS. 1 to 3, any auxiliary nib units of the type shown in FIG. 5 have to be housed separately, and not within a receptacle which is integral with cap 30.

Accordingly it will be seen that the present invention provides auxiliary nib units by which an ultra-fine nib can be quickly and easily placed into ink-transfer and load-bearing contact with the much-wider main nib of a marker pen, so that the marker pen provides the mechanical support and the ink supply for the ultra-fine nib, thus adding considerably to the range of uses of marker pens.

We claim:

1. A nib conversion unit for converting a marker implement having a fixed main nib of one size into an implement with an effective auxiliary nib of smaller size, the unit comprising a housing adapted to engage detachably the end of the implement adjacent to the main nib, the housing carrying a thin auxiliary nib adapted, when the housing is so engaged, to enter into liquid communication with the main nib and to project from the housing to operate as capillary-fed nib, the main nib being subject to wear such that a gap may be created between the main nib and the thin auxiliary nib, thereby preventing liquid communication between the main and auxiliary nibs, said auxiliary nib being movable axially of the housing, whereby it may be moved into ink-transfer contact with the main nib by force applied to the tip of the auxiliary nib, thereby closing any gap which may be created between the main and auxiliary nibs due to wear of the main nib.

2. A nib unit according to claim 1, wherein the housing is formed of one of a resilient rubber and plastics material, and wherein the auxiliary nib is extruded and made of plastic.

3. A nib unit as claimed in claim 1, in which the ratio of the cross sectional areas of the main nib and the auxiliary nib lies within the range of 6:1 to 1.5:1.

4. A nib unit as claimed in claim 1, in which the auxiliary nib includes means for receiving ink by end-to-end contact with the main nib.

5. A nib unit as claimed in claim 1, in which the main nib is formed from a plastics material.

6. A nib unit as claimed in claim 2, in which the extruded nib is sheathed with one of a metal and plastics.

7. A nib unit as claimed in claim 6, wherein the housing includes at least two ribs integral with the housing, the ribs defining channels along which air may flow and adapted to grip the auxiliary nib.

8. A marker unit having a tip of one of felt and fibre, and consisting of a barrel, a cap, an ink reservoir and a capillary fed main nib of one of felt and fibre and a nib conversion unit according to claim 1.

9. A marker unit according to claim 8, wherein the cap has a receptacle adapted to receive and store the nib conversion unit.

10. A marker unit according to claim 9, wherein the cap has a white markable area colourable by one of the main and auxiliary nib.

11. A nib unit as described in claim 1, in which the auxiliary nib includes means for receiving ink by side-by-side contact with the main nib.

12. A nib unit as described in claim 1, in which the main nib is formed from one of bonded fibres of nylon, polyester, and acrylic.

* * * * *